United States Patent [19]

Dewing et al.

[11] 4,226,618

[45] Oct. 7, 1980

[54] CARBOTHERMIC PRODUCTION OF ALUMINIUM

[75] Inventors: Ernest W. Dewing; Frederick W. Southam, both of Kingston, Canada

[73] Assignee: Alcan Research and Development Limited, Montreal, Canada

[21] Appl. No.: 64,582

[22] Filed: Aug. 7, 1979

[30] Foreign Application Priority Data

Aug. 21, 1978 [GB] United Kingdom ..... 34069/78

[51] Int. Cl.[2] ..... C22B 21/02

[52] U.S. Cl. ..... 75/68 A; 75/10 R; 75/25

[58] Field of Search ..... 75/25, 10 R, 68 R, 68 A

[56] References Cited

U.S. PATENT DOCUMENTS 4,099,959 7/1978 Dewing et al. ..... 75/68 A

*Primary Examiner*—M. J. Andrews

*Attorney, Agent, or Firm*—Cooper, Dunham, Clark, Griffin & Moran

[57] ABSTRACT

In a process for production of aluminium metal carbon monoxide gas evolved at very high temperature through reaction of aluminium carbide and alumina is cooled by contact with a molten alumina slag at a lower temperature to cause back reaction of contained aluminium suboxide and Al vapor and consequent heat transfer to the contacted molten alumina slag.

9 Claims, 2 Drawing Figures

CARBOTHERMIC PRODUCTION OF ALUMINIUM

BACKGROUND OF THE INVENTION

The present invention relates to the carbothermic reduction of alumina to produce aluminium metal.

There is described in U.S. Pat. No. 4,099,959 and in Pat. Applications Ser. Nos. 962,622, 962,630 and 962,652 a process in which a molten alumina slag containing dissolved aluminium carbide, travels successively through a zone of relatively low temperature, in which carbon feed material is added to the slag to react with alumina to augment the aluminium carbide content of the slag, and a zone of relatively high temperature in which aluminium carbide reacts with alumina to release aluminium metal which is collected and separated from the slag, the aluminium carbide content of the slag being simultaneously reduced.

The slag from the high temperature zone may be returned to the preceding low temperature zone in a 2-vessel system or it may be forwarded to a succeeding low temperature zone in a multi-vessel system.

The reaction in the low temperature zone may be represented as $$2Al_2O_3+9C\ Ai_4C_3(\text{in solution})+6CO$$

whereas the reaction in the high temperature zone may be represented as $$Al_4C_3(\text{in solution})+Al_2O_3\ 6Al+3CO.$$

These reactions are both highly endothermic and respectively proceed at temperatures within the ranges of about 1950°–2050° C. and about 2050°–2150° C. respectively.

The large volumes of gas released in the low temperature zone and in the high temperature zone carry substantial quantities of fume (both Al metal vapour and aluminium suboxide $Al_2O$). The amount of fume carried by the evolved CO is considerably greater in the gas evolved in the high temperature zone than in the gas from the low temperature zone because of the higher temperature. This is true whenever the carbothermic reduction of alumina is carried out in a system where the two above-mentioned reactions proceed in different zones of the system.

In U.S. Pat. No. 4,099,959 there is described an arrangement by which fume components can be removed from the evolved gas by passing the gas through the carbon feed material prior to introduction of the feed material to the low temperature zone.

It is an objective of the present invention to provide a simplified and more efficient procedure for the removal of fume components from the evolved gas. The method of the present invention is preferably used to complement the already described fume removal system and is particularly intended to achieve cooling of and partial fume removal from the gas evolved in the high temperature zone before subjection to the treatment described in U.S. Pat. No. 4,099,959.

SUMMARY OF THE INVENTION

In its broadest aspect the present invention contemplates effecting the recovery of $Al_2O$ and Al vapour from the evolved gas by contact with a molten alumina slag, containing dissolved $Al_4C_3$, at a lower temperature than said gas under conditions to effect substantial cooling of said gas and thus to effect at least partial exothermic back-reaction of said $Al_2O$ and Al vapour with carbon monoxide. As a consequence of this contact the alumina slag rises in temperature by taking up a substantial proportion of the available chemical energy of the fume components of the gas and takes up some additional energy from the sensible heat of the gas. The $Al_2O$ and Al fume content of the gas from the high temperature zone is correspondingly reduced. The heat take-up by the slag allows it to react with additional carbon to increase its aluminium carbide content until equilibrium is restored. The contact of the fume-laden gas with alumina slag is thus preferably effected in the presence of carbon, which reacts endothermically with the alumina slag, thus cooling the slag.

In putting the invention into effect the most convenient route for effecting the required contact is by passing the gas evolved in a high temperature zone to a low temperature zone in such a way that it is bubbled through the molten slag in the low temperature zone so that it approaches thermal and chemical equilibrium with the slag in the low temperature zone. In the low temperature zone there will usually be a supernatant layer of carbon feed material, which will assist in dispersing the bubble stream and will also participate in chemical reactions with gaseous Al and $Al_2O$, thus assisting in achieving chemical and thermal equilibrium. The evolution of heat helps to provide at least part of the heat requirement of the endothermic reaction between alumina and carbon in the first zone.

It will be understood that where the method of the present invention is practised in a system in which there are a series of alternate low temperature zones and high temperature zones, the evolved gas may be passed back from a high temperature zone to the preceding low temperature zone or forward to a succeeding low temperature zone.

The method of the present invention requires that the gas space in the high temperature zone be maintained at a higher pressure than in the low temperature zone in order to drive the gas from the high temperature zone through the molten slag in the low temperature zone. A sufficient driving pressure in the second zone may exist when the slag level in it is only 25–50 cms lower than the slag level in the first zone.

Since the gas is being brought substantially into chemical and thermal equilibrium with the slag and carbon in the low temperature zone, its temperature and fume content will have been reduced to values typical of that zone.

It is preferred in a 2-vessel system to introduce the gas from the second zone into the first zone in such a way as to cause an electrical discontinuity or zone of high resistance either in the slag return conduit or adjacent to its exit into the low temperature zone. The provision of the discontinuity or zone of high resistance is for the purpose of rendering the forward conduit effectively the sole current carrier between the first and second zones as discussed in Pat. Application Ser. No. 962,652. For this purpose the exit of the gas conduit from the second zone is preferably into the slag return conduit at or near its exit into the first zone vessel. In this way the gas stream from the second zone vessel (the products collection vessel) may be employed to assist slag circulation by acting as a gas lift pump.

DETAILED DESCRIPTION

Figure 1:
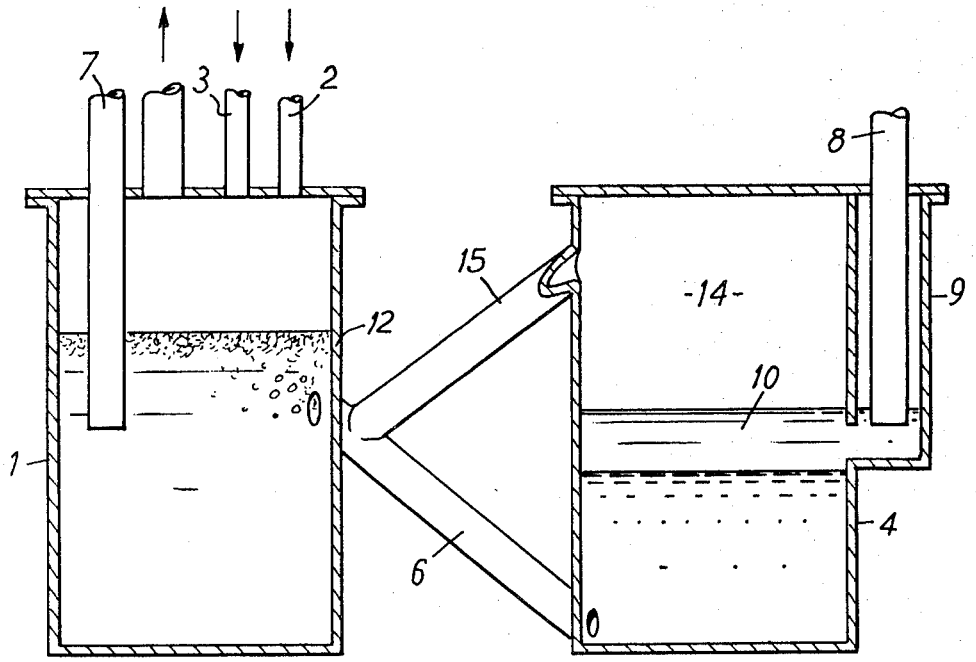
Figure 2:
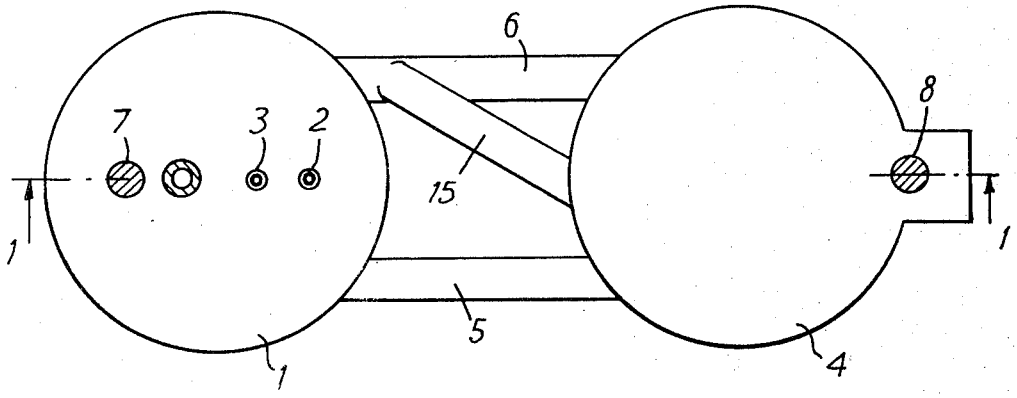

In the accompanying drawings FIGS. 1 and 2 show diagrammatically a side view and a plan view respectively of a 2-vessel system for carrying out the present invention.

The vessel 1 constitutes the low temperature zone of the system and includes supply conduits 2 and 3 for the introduction of carbon and alumina feed materials respectively. The vessel is provided with a gas outlet conduit for release of gas evolved in both zones of the system.

The low temperature zone first vessel 1 is connected with high temperature zone second vessel 4 by a forward flow conduit 5 for for the slag in which a major part of the second zone reaction occurs. As already disclosed in U.S. Pat. No. 4,099,959 the evolution of gas in this upwardly sloping flow conduit 5 promotes circulation of slag in the system, the slag returning from the vessel 4 to the vessel 1 through an upwardly directed return conduit 6. The heat input to the system is achieved by means of electrical resistance heating by passage of current between electrodes 7 and 8 in the first and second vessels respectively. To protect electrode 8 from attack by the slag in the vessel 4 it is arranged in a side well 9 so as to be out of direct contact with the slag, being only in direct contact with a relatively cool layer 10 of product aluminium.

In the first vessel 1 the reaction between the slag returned from the second vessel 4 and fresh carbon takes place essentially in the region of a supernatant layer 12 of carbon particles supplied via the supply conduit 2.

In accordance with the present invention the second vessel is essentially enclosed to provide a gas space 14, which in operation will be at super-atmospheric pressure. A gas flow conduit 15 leads from the space 14 into the exit region of the slag return conduit 6, so as to provide a zone of high electrical resistance, amounting to a virtual electrical discontinuity in this region. This ensures that 90% or more of the current passing between the electrodes 7 and 8 passes through the flow conduit 5, so that the major heat generation by electrical resistance heating occurs in the forward flow conduit, since the electrical resistance of the slag mass in the vessels 1 and 4 is low in relation to the resistance of the slag in the relatively restricted passage in the flow conduit 5.

We claim:

1. In a process for the production of aluminium metal in which a circulating stream of molten alumina slag containing aluminium carbide is passed through one or more zones of relatively low temperature at which carbon feed is introduced for reaction with alumina to form additional aluminium carbide with evolution of carbon monoxide gas and through one or more zones maintained at a higher temperature such that aluminium carbide reacts with alumina for production of aluminium metal with evolution of carbon monoxide gas having a significant content of gaseous aluminium suboxide and aluminium vapour the improvement which comprises contacting the carbon monoxide gas evolved in said high temperature zone or zones with molten alumina slag, containing dissolved aluminium carbide, at a lower temperature than said gas under conditions to effect substantial cooling of said gas and thus to effect at least partial exothermix back-reaction of aluminium suboxide and said aluminium vapour with carbon monoxide.

2. The process of claim 1 in which the contact of said molten slag and said carbon monoxide gas is performed in the presence of carbon.

3. In a process for the production of aluminium metal in which a circulating stream of molten aluminium slag containing combined carbon is passed through one or more zones of relatively low temperature at which carbon feed is added for reaction with alumina to form aluminium carbide with evolution of carbon monoxide gas and through one or more zones maintained at a higher temperature such that aluminium carbide reacts with alumina for production of aluminium metal with evolution of further carbon monoxide gas having a content of aluminium suboxide and aluminium vapour higher than that of carbon monoxide evolved in a low temperature zone or zones the improvement which consists in leading a stream of gas from a high temperature zone to a low temperature zone, bringing said stream of gas into intimate contact with the liquid slag in said low temperature zone to cool said gas to react a part of the aluminium suboxide and aluminium vapour fume content of said gas with said slag in said low temperature zone and discharging a stream of gas from said low temperature zone.

4. A process according to claim 3 in which said stream of gas from a high temperature zone is bubbled through the slag in said low temperature zone.

5. A process according to claim 3 further including maintaining a layer of unreacted carbon on the slag in said low temperature zone and introducing said stream of gas into said low temperature zone at a location beneath said layer or unreacted carbon.

6. A process according to claim 3 further including maintaining the slag level in the low temperature zone at a height of about 25 cms to about 50 cms above the level of the slag in the high temperature zone.

7. A process according to claim 3 further including introducing said stream of gas into a conduit leading a stream of slag into said low temperature zone whereby to establish a zone of high electrical resistance in said stream of slag in said conduit.

8. A process according to claim 7 further including introducing said stream of gas into said conduit at a position adjacent the exit end of said conduit.

9. A process according to claim 3 further including introducing alumina feed material into said low temperature zone.

* * * * *